United States Patent [19]

Tateishi

[11] Patent Number: 4,743,737

[45] Date of Patent: May 10, 1988

[54] OSCILLATING LOUVER ELECTRIC FAN HEATER

[76] Inventor: Arthur K. Tateishi, Apt. 202, 25 Warrender Avenue, Toronto, Ontario, Canada, M9B 5Z4

[21] Appl. No.: 11,886

[22] Filed: Feb. 6, 1987

Related U.S. Application Data

[63] Continuation-in-part of Ser. No. 831,190, Feb. 20, 1986.

[51] Int. Cl.[4] ..... F24H 3/04; H05B 1/00; F04D 25/10; F24F 13/16

[52] U.S. Cl. ..... 219/368; 98/40.3; 98/121.2; 165/99; 219/366; 219/370; 219/371; 219/373; 415/125; 416/100; 417/361

[58] Field of Search ..... 219/366–372, 219/365, 359, 373; 165/99; 415/125; 98/40.3, 121.2; 417/361; 416/100

[56] References Cited

U.S. PATENT DOCUMENTS

| | | | |
|---|---|---|---|
| 697,448 | 4/1902 | Coleman | 415/125 |
| 2,018,535 | 10/1935 | Rober | 165/99 X |
| 2,036,597 | 4/1936 | Meyrowitz | 219/371 |
| 2,037,250 | 4/1936 | MacDonald | 415/125 |
| 2,124,716 | 7/1938 | Sperry | 165/99 X |
| 2,768,782 | 10/1956 | Tateishi | 417/361 |
| 3,147,367 | 9/1964 | Magnusson | 219/370 X |
| 3,173,478 | 3/1965 | Maycen | 219/370 X |
| 3,380,372 | 4/1968 | Perry | 98/121.2 |
| 4,084,491 | 4/1978 | Spotts et al. | 98/121.2 |
| 4,217,816 | 8/1980 | Manginelli | 415/125 X |
| 4,309,595 | 1/1982 | Long et al. | 219/370 |
| 4,437,394 | 3/1984 | Tateishi | 98/40.3 |

FOREIGN PATENT DOCUMENTS

| | | | |
|---|---|---|---|
| 642202 | 2/1937 | Fed. Rep. of Germany | 415/125 |
| 451597 | 8/1936 | United Kingdom | 415/125 |
| 630391 | 10/1949 | United Kingdom | 416/100 |
| 654893 | 7/1951 | United Kingdom | 415/125 |
| 927134 | 5/1963 | United Kingdom | 415/125 |

*Primary Examiner*—Anthony Bartis

[57] ABSTRACT

An electric fan heater includes a stationary housing and a louver blade assembly having a plurality of oscillating louver blades located forwardly in the housing for providing multidirectional hot air flow from the heater. The heater also includes a drive system for the louver blade assembly with the drive system comprising lightweight plastic drive gears and a small rubber drive belt located rearwardly in the housing as well as a lightweight plastic connecting shaft extending forwardly from the drive gears to the louver blade assembly. The electric heating element for providing hot air from the heater is positioned between the louver blade assembly and the plastic drive gears. The gears and connecting shaft are located in the housing laterally outwardly from the heating element to avoid direct exposure to the heat therefrom. A common motor is used to operate both the heater and the fan blade which is positioned to move the hot air forwardly from the heating element out past the louver blades and away from the drive gears and to draw cooling air to the drive gears, connecting shaft and rubber drive belt which is further protected by a heat shield between the heating element and the drive belt.

5 Claims, 4 Drawing Sheets

43
3
33
34
37
39
53
27
29
57
70
31
49
47
51
53a
11
5a
5
ELECTRIC HEATER
15
13
9
53a
11
5a

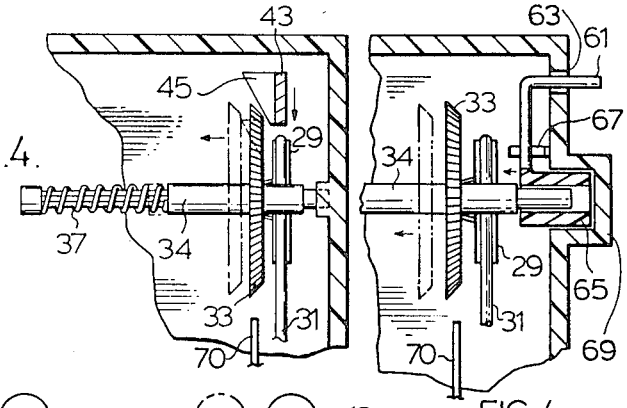
FIG.4.
FIG.4a.
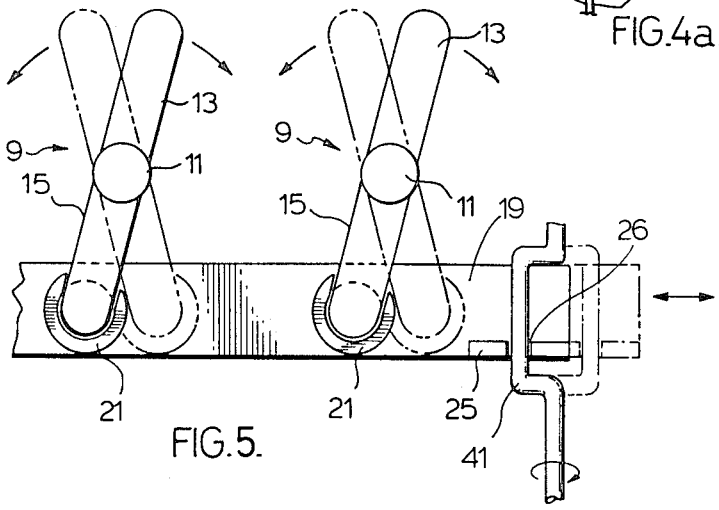
FIG.5.
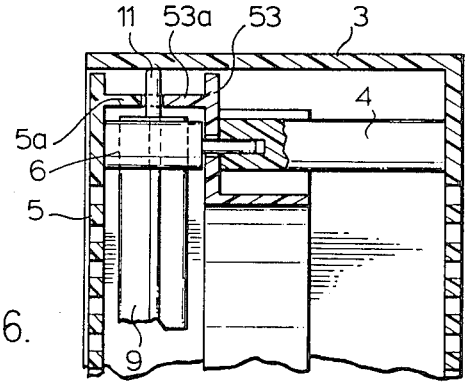
FIG.6.

OSCILLATING LOUVER ELECTRIC FAN HEATER

This is a continuation in-part application of earlier filed U.S. patent application Ser. No. 831,190 for OSCILLATING LOUVER FAN HEATER, filed Feb. 20, 1986 by Arthur Tateishi.

FIELD OF THE INVENTION

The present invention relates to a fan heater with a stationary housing and louver blades which oscillate relative to the housing to provide a multidirectional hot air flow from the heater.

BACKGROUND OF THE INVENTION

Over the last few years there has been a very substantial demand for portable electric heaters which can be moved from room to room in a house or building. Some of these heaters operate using radiant or convection heating techniques. In addition there are many newly designed portable heaters which operate using a fan heater and these fan type heaters have been particularly well suited for the most up to date molding techniques which has resulted in even more compact constructions adding to the portability of the fan heater.

One noticeable drawback resulting from the most recent fan heater constructions as described immediately above is that they are very localized in terms of direction of air flow from the heater, i.e. the hot air is blown in one direction only and because the heaters themselves are quite small this limits the area covered by the heater.

I have earlier developed an oscillating louver arrangement for use in a fan construction as covered in Canadian patent No. 1,130,251 issued Aug. 24, 1982 and it's counterpart corresponding U.S. Pat. No. 4,437,394 issued Mar. 20, 1984. The specific modular construction from my earlier fan is also covered by Canadian patent No. 1,169,828 issued June 26, 1984. The concept of movable louvers which are described in the above noted patents would provide substantially increased heat coverage when used in combination with a heater fan. However, it is important that the gearing used to drive the louver blades should not be affected by heat buildup within the heater fan particularly in view of the potential of using lightweight plastic in the construction of this gearing. Such lightweight plastics are very important from a commercial standpoint in that they can be produced on a mass basis using standard molding techniques at a very low cost. From a use standpoint, the lightweight plastic components are extremely beneficial in that they present almost no load which would otherwise adversely effect the fan aspect of the heater. However, from a negative standpoint there are problems associated with using lightweight plastic in close proximity to the heating element of a fan heater because of the potential of heat related damage to the plastic.

For example, there have recently been a few attempts to construct plastic oscillating fan heaters. However, prior to my invention, these attempts have required side to side movement of the entire heater housing mounted atop a separate motor and drive system control outside of that housing. Therefore, two motors are used, one for the fan blade and heater operation and the other for oscillating the housing containing the fan blade and heater. Again, this has been expensive and complicated because of the inability to prevent heat damage to the plastic drive components which when located directly within the housing with the heater are otherwise useable to operate a louver system rather than having to oscillate the entire housing.

SUMMARY OF THE PRESENT INVENTION

The present invention provides a fan heater designed for increasing heating coverage in comparison to a conventional fan heater while using lightweight plastic components without being subject to heat buildup problems. More particularly, the fan heater of the present invention comprises a stationary housing with front and back surfaces, a louver blade assembly having a plurality of oscillating louver blades located at the front surface of the housing for providing multidirectional hot air flow from the heater, a drive system for the louver blade assembly comprising plastic gears and a rubber drive belt located rearwardly in the housing as well as a plastic connecting shaft extending forwardly from the gears to the louver blade assembly. Also provided within the housing are a heater for providing the hot air, a fan blade for circulating the hot air and a motor for operating both the fan blade and the drive gears which in turn operate oscillating louver blades. In accordance with the present invention, the fan blade is positioned forwardly of the heater which is in turn located forwardly of the rubber drive belt and plastic gears. The rubber drive belt, although directly behind the heater, is isolated from its direct heating effect by means of a heat shield between the heater and the drive belt and the entire assembly is set up such that the fan blade moves the hot air forwardly away from the heater out through the front surface of the housing past the louver blades away from the rubber drive belt and plastic gears while drawing cooling air in through the vented rear surface of the housing to the plastic gears and rubber drive belt to prevent related damage to the drive system for the louver blade assembly.

BRIEF DISCUSSION OF THE DRAWINGS

The above as well as other advantages and features of the present invention will be described in greater detail according to the preferred embodiments of the present invention in which:

FIG. 4 is a side plan view of the control region for the drive system from the fan heater of FIG. 1.

FIG. 4*a* is a side plan view of an alternate control region for the drive system according to a further preferred embodiment of the present invention.

FIG. 5 is a top plan view of the louver blade assembly showing oscillation of the louver blades.

Figure 1:
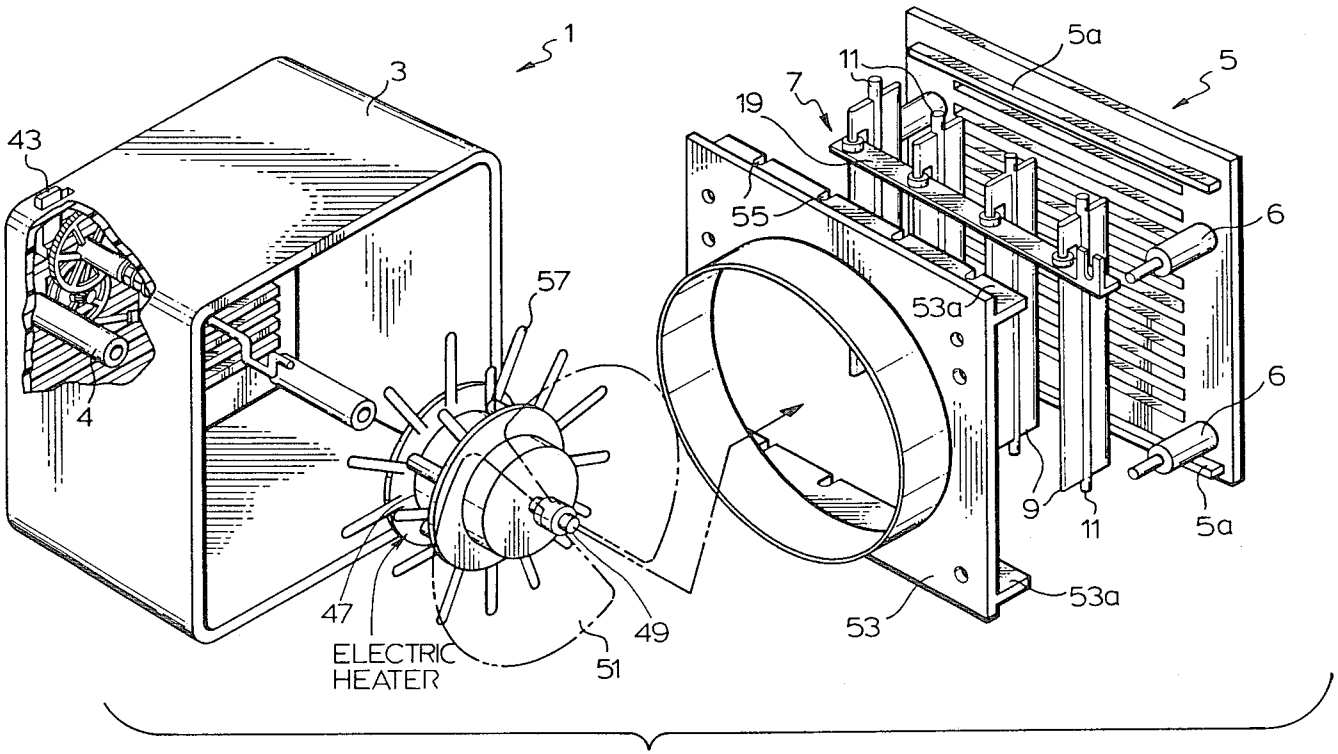
FIG. 1 is an exploded perspective view of a fan heater according to a preferred embodiment of the present invention.

FIG. 6 is a sectional view at the upper end of the fan heater of FIG. 1 when fully assembled and in particular showing the fitting of the louver blades to the fan housing according to a preferred embodiment of the present invention.

DETAILED DESCRIPTION ACCORDING TO THE PREFERRED EMBODIMENTS OF THE PRESENT INVENTION

Figure 2:
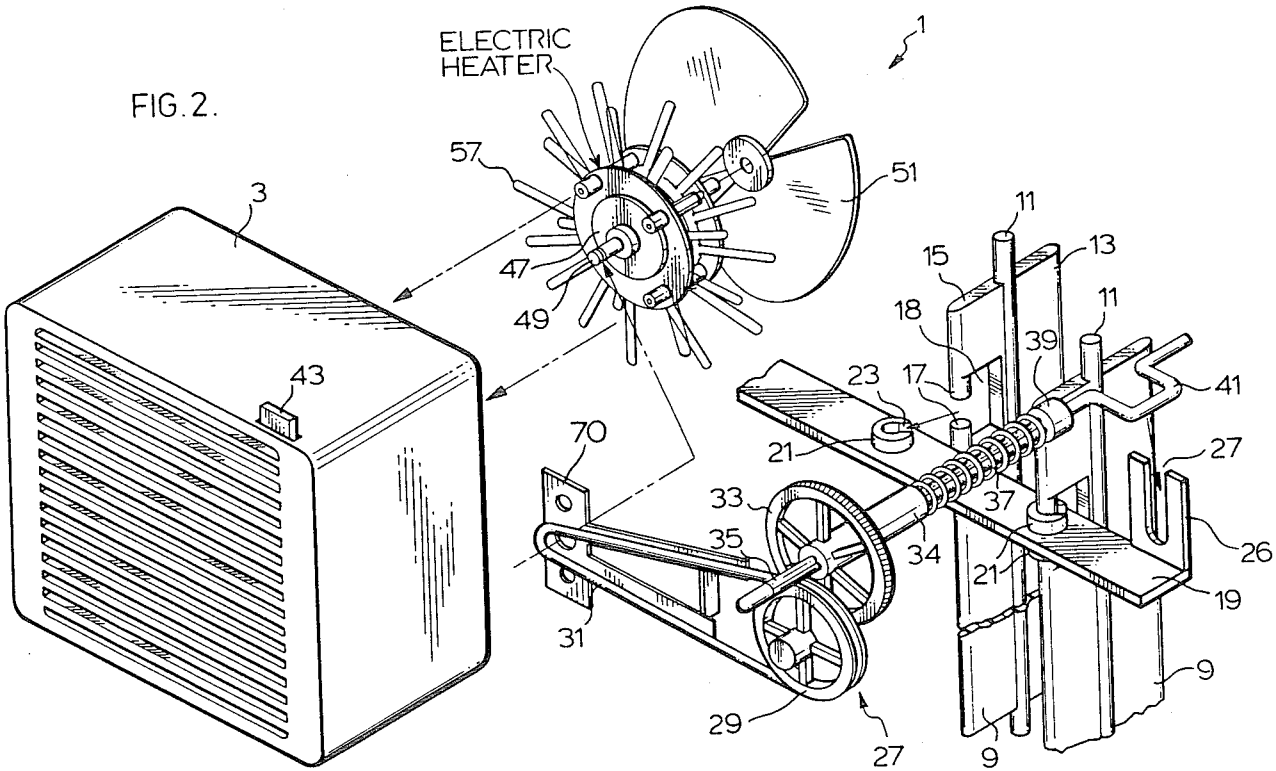
FIG. 2 is a further exploded perspective view showing a partial enlargement of the drive system and louver blade assembly from the fan heater of FIG. 1.

FIGS. 1 and 2 show the components for the overall heater construction generally indicated at 1. These components include a main casing portion 3 which forms the side, top, bottom and back wall regions of the heater housing which is then completed at the forward side of the housing by casing portion 5. It is to be noted that the housing itself remains stationary while the fan heater is in operation.

The main operating components located within the housing comprise an electrical motor 47 which operates a fan blade 51, an electrical resistance heater 57 located immediately around motor 47, a louver blade assembly generally indicated at 7 in FIG. 1 and positioned at the front of the housing and a drive system generally indicated at 27 in FIG. 2 which is operated from motor 47 for providing oscillation of the louver blade assembly.

The louver blade assembly itself consists of a plurality of individual louver blades 9 each of which includes upper and lower central pivot mountings 11 rotatably fitted within the casing as well shown in FIG. 3 of the drawings and to be described later in greater detail.

Returning to FIG. 2, each of the louver blades 9 includes spaced apart rounded arms 17 which slide through slots 23 into bosses 21 on the upper and lower sides of control bar 19 to which the louver blades are coupled. It will be noted that the slots in the bosses are angled along the longitudinal axis of bar 19 which when the fan is unassembled allows easy insertion of arms 17 into the bosses, but which once the fan is assembled prevents the arms from sliding out of the bosses and insuring coupling of the louver blades with the control bar. It will also be seen in FIG. 2 that the louver blades themselves are actually recesses as indicated at 18 to permit their side to side movement without interference from bar 19 when the louver blade assembly is in operation.

Drive system 27 for the louver blade operation includes a first drive wheel 29 which is coupled by means of a small endless rubber belt 31 directly to output shaft 49 of electric motor 47. As seen in FIG. 2 the shaft is recessed to positively receive belt 31. The drive system also includes a further drive wheel 33 slideably mounted on and rotatably coupled to a connecting shaft 35 extending forwardly from the drive wheels to the louver blade assembly. Drive wheel 33 is normally biased into contact with drive wheel 29 by means of spring 37 trapped between extension 34 of wheel 33 and a stop portion 39 forming part of the connecting shaft. The actual meshing between wheels 29 and 33 can be well seen in the upper left hand corner of FIG. 3 of the drawings showing spring 37 in its naturally extending condition.

Connecting shaft 35 is provided at its forward end with a crank portion 41 which fits into slot 26 of a generally U shaped upright crank receiving portion 25 of control bar 19. This arrangement operates in a manner such that when gear wheel 33 driven off gear wheel 29 rotates connecting shaft 35 there is an orbital movement at crank portion 41 which causes control bar 19 to reciprocate from side to side across the front of the fan housing. This provides an oscillation of each of the louver blades 9 as well seen in FIG. 5 of the drawings.

Figure 3:
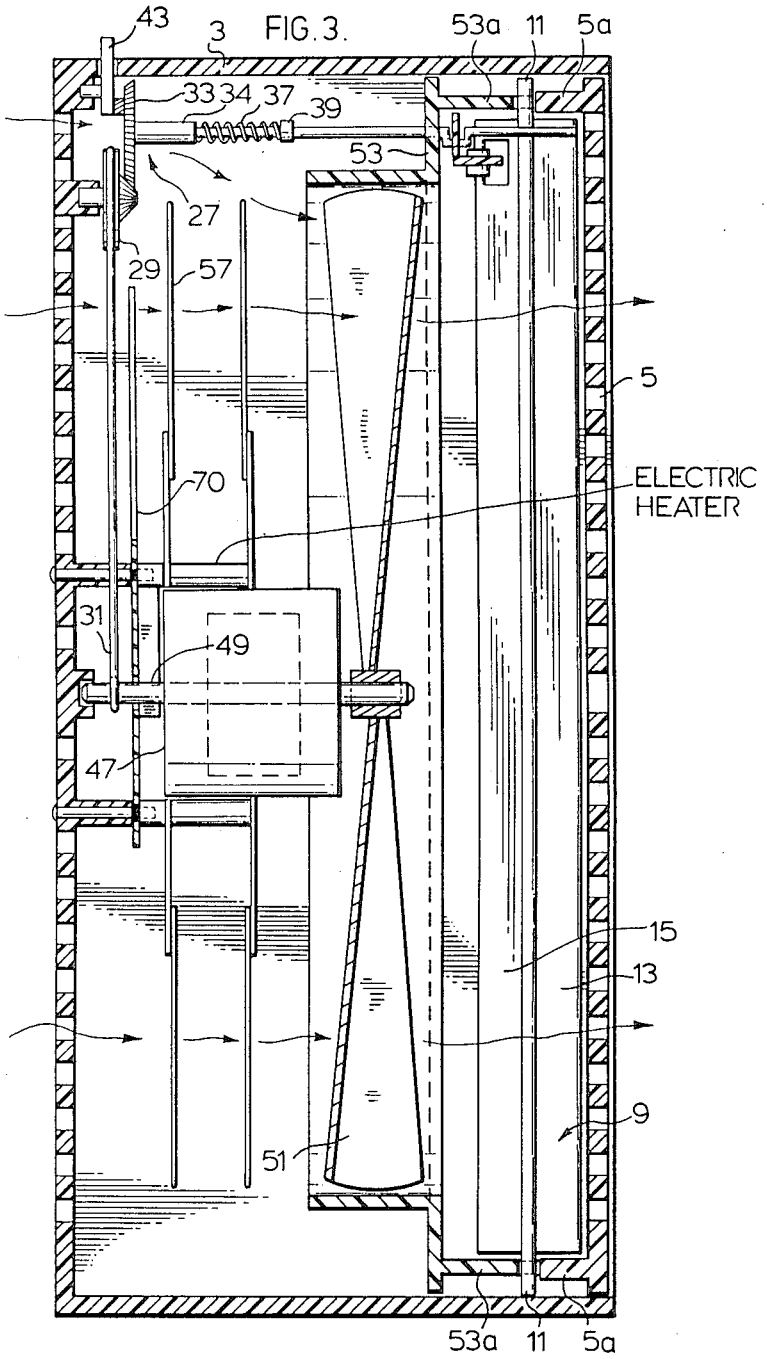
FIG. 3 is a sectional view through the fan heater of FIG. 1 when fully assembled.

The actual mounting of the louver blade assembly is best seen having reference to FIGS. 1, 3 and 6 of the drawings. Referring particularly to FIG. 1, the fan housing includes a fan blade guide 53 having a forwardly projecting shelf **53*a* provided with a plurality of slots or openings 55. This shelf cooperates with the rearwardly projecting shelf 5*a* on forward housing or casing portion 5 at both the upper and lower ends of the fan for trapping the pivot pins or mounts 11 on the louver blades as clearly seen in FIG. 3 of the drawings. The entire housing with the components fitted as described above is secured by means of posts 6 on the forward housing portion fitting into the forwardly projecting studs 4 on the main housing portion 3 as seen in FIG. 1**.

When the fan is in operation fan motor 47 rotates fan blade 51 which draws air in through the vented back of the heater and forces that air forwardly past the louver blades out the front vents of the heater as well seen in FIG. 3.

It will be noted that fan blade 51 is mounted to the forward end of motor shaft 49 while belt 31 wraps around the back end of the motor output shaft. Accordingly, both the fan blade and the drive system for the louver blade assembly run off the same fan motor and an important feature of the present invention is the use of lightweight rubber in the belt and lightweight plastic components in forming both the gear drive system and the louver blade assembly so as to minimize power requirements for operation of the louver blades and allow the use of a single motor to both rotate the fan blade and operate the louver blade assembly. In addition, each of the louver blades is set up to have a balanced air flow load between the front and rear blade portions 13 and 15 respectively of the louver blades. More specifically, as the fan blade blows the air forwardly to the louver blades the air impact or load is equal at the front and the back of each louver blade so that there is no overall biasing effect created by the air flow. Otherwise there would be a resistance to oscillation of each of the blades requiring more power from the fan motor to overcome this potential resistance. However by providing the central pivot mounting of each of the louver blades with an equal amount of blade portion to either side of the pivot point, there is a balanced load on the louvers resulting in substantially no power drain drom the motor in operating the louver blade assembly.

As typically the case the fan heater of the present invention can operate in either strictly the fan mode for summer use or in a heater mode for winter use. This is controlled through an on/off control member not shown in the drawings and not forming part of the present invention. However, it is to be noted that the heater can not be operated without the fan and one of the critical features of the present invention relates to the positioning of the internal operating components with the fan being used to prevent heat related damage when operated in the heating mode.

Referring again to FIG. 3 it will be seen that electrical resistance heater 57 providing the source of heat energy for the hot air blown from the heater is positioned forwardly of the drive belt and gear wheels for drive system 27 which are themselves positioned generally to the rear of the housing. Therefore the drive belt, which is isolated from direct exposure to heater 57 by a heat shield 70 covering the length of the belt as seen in FIG. 3, the gear wheels and the heater are all on the negative pressure side of fan blade 51 which when rotating, and as earlier described, draws air in through the vented back of the housing and forces the air forwardly through the louver blade assembly. Accordingly, the fan blade pulls the hot air forwardly from heater 57 away from the drive belt and gear wheels and also draws cooling air forwardly to the gear wheels through the back of the housing. Therefore, there is very little if any heat buildup rearwardly of the heater. Furthermore, the drive belt, heat shielded between the motor shaft and the gear wheels, acts as a connector from the motor shaft to the gear wheels which are spaced outwardly from being positioned directly behind the heater, so that in combination with the incoming air draw, the gear wheels are located in an effectively cooled region of the heater. It is to be noted that the on/off control for the heater also controls the fan whereby the heater will not operate without rotation of the fan blade so that there is no chance of overheating because of lack of cooling incoming air.

This effective isolation of the drive system away from the heat generated by the electrical resistance heater is particularly important when again bearing in mind the lightweight plastic, and preferrably nylon, construction of the gear wheels which might otherwise be subject to warping problems and the like due to excessive heat buildup. As a further preferred embodiment feature it is to be noted that each of the gear wheels 29 and 33 has an open spoke construction extending in an upright position sideways across the housing such that the cooling air brought in from the back of the housing actually flows directly through and further cools the two drive wheels. In addition the connecting shaft from the drive wheels forwardly to the louver blade assembly is isolated from the effects of heater 57 by the air flow characteristics created by fan blade 51 as clearly seen in FIG. 3.

Again it is to be remembered that the use of lightweight plastic material in the drive system construction lends itself extremely well to operation of both the drive system and the fan blade from a single small powered motor with little if any power drain on the motor because of the very limited load required to operate these lightweight components. In fact, it would appear that because of the balanced load on each of the louvers the only resistance to operation of the drive system is the friction of the components and because this resistance is so limited the components themselves are made in very small size further reducing resistance. By way of example belt 31 has a diameter of about 1/16" which is all that is required to operate the entire drive system for the louver blades. At this very small diameter, the drive belt is easily stretched to remain taut and provide a very positive driving connection from the motor shaft to the gears with substantially no load on the system. Furthermore, because the entire drive sytem for the louver operation is made from lightweight plastic, there is essentially no load to cause any slippage between the drive belt and the gears or the motor shaft without requiring any special non-slip connectors or the like.

All of the description above relates to the louver blade assembly operating in conjunction with the fan motor. However, according to a further preferred embodiment of the present invention the heater fan is provided with an on/off control for disconnecting the drive system to the louver blade assembly while the fan motor is in operation. This on/off control is best seen in FIGS. 3 and 4 of the drawings.

More specifically, provided to the rear of the housing is an on/off button 43 having a bevelled or cammed lower end 45. When the button is in the up position the bevelled end 45 is out of contact with the louver blade drive system, however, by depressing button 43 bevelled end 45 engages with the bevelled surface on gear wheel 33 as shown in FIG. 4 and forces this gear wheel to slide forwardly against the spring 37 on shaft 34 which seats in a bearing at the front of the housing to prevent movement of the shaft itself. Therefore, although gear wheel 33 normally meshes with gear or drive wheel 29 when spring 37 is in its naturally extended position the two gear wheels can be separated from one another by control button 43 to interrupt rotation of shaft 35 and discontinue any further oscillation of the louver blades. As soon as control button 43 is moved back to its up or elevated position cam surface 45 moves away from gear wheel 33 allowing spring 37 to force the gear wheel back into meshing engagement with drive wheel 29 which continues to rotate regardless of the positioning of control button 43 as long as the fan is in operation.

FIG. 4*a* shows a modified louver drive system control comprising a sliding on/off switch 61 fitted through an elongated slot 63 at the back of the housing and a cam surface 67 over which switch 61 slides for disengaging louver oscillation. Switch 61 includes its own cup portion 65 which fits into bearing region 69 of the housing casing. By sliding switch 61 over cam surface 67 cup portion 65 pushes shaft 34 and wheel 33 away from wheel 29 to discontinue rotation of shaft 34 and turn off louver oscillation. When switch 61 is not sitting on cam surface 67 wheels 33 and 29 engage one another because of pressure from spring 37 to provide oscillation of the louver blades.

One very useful feature of providing the on/off control for the oscillation drive is that by simply disengaging the two drive wheels at the appropriate time the louvers can be set at any desired position. With this arrangement the direction of air flow is easily controlled and varied without having to move the heater itself which can be critical when working in tight space constraints.

It should be noted that in my earlier U.S. Pat. No. 4,437,394 I also provide a separable gear arrangement to turning on and off louver operation. However, in my earlier patent which is directed to a fan and not a fan heater, the movable gear slides on a vertical shaft. This is to be contrasted to the present invention where, in order to allow cooling air to flow through the moveable gear as required in the use of my heater, I set the gear to sit vertically and to slide in a horizontal direction. This results in a potential problem of ensuring that the two gear wheels properly engage with one another when in the oscillation mode as opposed to my earlier patent where the weight of the gear wheel itself helps to ensure positive contact. However, in this case I overcome any problems by using, in combination with my spring which is of lightweight pressure itself for easy separation of the gears, co-operative bevelled gear contacts on the two gear wheels 29 and 33 as is well seen in FIG. 3. This bevelling of the gears allows for tolerances in the actual contact region while still ensuring that gear wheel 33 is positively rotated off of gear wheel 29. Here again it should be appreciated, that because there is only a light load resulting from the lightweight plastic drive components for the louver operation, there is no requirement for a strong spring bias on gear wheel 33 to ensure positive driving contact with gear wheel 29.

From the description above it will now be clearly seen how even a very small fan heater made with the most up to date plastics and plastic molding techniques will provide heat coverage for large areas by incorporating the louver concept of the present invention.

Although various preferred embodiments of the invention have been described herein in detail, it will be appreciated by those skilled in the art that variations may be made thereto without depart from the spirit of the invention or the scope of the appended claims.

The embodiments of the inventon in which an exclusive property or privilege is claimed are defined as follows:

1. A fan heater comprising a stationary housing with a front surface having an air outlet and a back surface having an air inlet, a louver blade assembly having a plurality of oscillating louver blades located at the front surface of said housing for directional control of air movement out of said housing through said air outlet, a drive system for oscillating the louver blade assembly and comprising plastic gears and a rubber drive belt located rearwardly in the housing located in a path of cool air flowing into the housing through the air inlet at the back surface thereof and a rotatable plastic connecting shaft extending forwardly from said plastic gears to said louver blade assembly, means associated with said shaft for converting rotary movement of said shaft to oscillating movement of said louver blades, an electric heater in said housing for providing hot air be heating air flowing through the housing from said air inlet to said air outlet, a fan blade in said housing for causing the flow of air therethrough and a motor in said housing for directly rotating said fan blade and being operatively connected by said drive belt to said gears for rotating said shaft to cause oscillation of said louver blades, said fan blade being positioned forwardly of said heater which is in turn located forwardly of said rubber drive belt and plastic gears, said rubber drive belt being separated from said heater by a heat shield, said heater being arranged such that said fan blade moves the hot air forwardly away from the heater out through the air outlet at said front surface of said housing past said louver blades away from said rubber drive belt and plastic gears while drawing cooling air in through said air inlet at said back surface of said housing to said plastic gears and rubber drive belt, and said plastic gears and said plastic connecting shaft being located laterally outwardly from said heater to prevent heat related damage to said drive system for said louver blade assembly.

2. A fan heater as claimed in claim 1, wherein said rubber drive belt is covered over part of its length from the motor shaft to said plastic gears by said heat shield.

3. A fan heater, as claimed in claim 1, wherein said rubber drive belt has a diameter of about 1/16 inches.

4. A fan heater as claimed in claim 1, wherein said connecting shaft is horizontally disposed and said plastic gears comprises first and second spoked gear wheels oriented transversely to the air flow direction from said air inlet to said air outlet, said second gear wheel being spring biased in to contact with said first gear wheel and being slideable horizontally along said connecting shaft by a control member to disengage from said first gear wheel thereby shutting off louver blade oscillation.

5. A fan heater, as claimed in claim 4, wherein said first and second gear wheels each include bevelled gear regions which are in contact when said second gear wheel engages with said first gear wheel.

* * * * *